US012305395B2

(12) United States Patent
Lowrey et al.

(10) Patent No.: US 12,305,395 B2
(45) Date of Patent: May 20, 2025

(54) ROOFING SHINGLES, AND BUNDLE OF ROOFING SHINGLES

(71) Applicant: BMIC LLC, Dallas, TX (US)

(72) Inventors: Thomas Lowrey, Waxahachie, TX (US); Lyan Ortiz, Waxahachie, TX (US); Nicholas Soto, Waxahachie, TX (US)

(73) Assignee: BMIC LLC, Dallas, TX (US)

( * ) Notice: Subject to any disclaimer, the term of this patent is extended or adjusted under 35 U.S.C. 154(b) by 0 days.

(21) Appl. No.: 18/771,122

(22) Filed: Jul. 12, 2024

(65) Prior Publication Data

US 2025/0019970 A1 Jan. 16, 2025

Related U.S. Application Data

(60) Provisional application No. 63/633,123, filed on Apr. 12, 2024, provisional application No. 63/513,620, filed on Jul. 14, 2023.

(51) Int. Cl.
*E04D 1/12* (2006.01)
*E04D 1/26* (2006.01)

(52) U.S. Cl.
CPC *E04D 1/12* (2013.01); *E04D 1/26* (2013.01)

(58) Field of Classification Search
CPC ..... E04D 1/12; E04D 1/26
See application file for complete search history.

(56) References Cited

U.S. PATENT DOCUMENTS

| | | | | |
|---|---|---|---|---|
| 4,825,616 | A * | 5/1989 | Bondoc | E04D 1/20 52/518 |
| 6,021,611 | A * | 2/2000 | Wells | E04D 1/265 52/309.1 |
| 8,978,332 | B2 | 3/2015 | Leitch | |
| 9,017,791 | B2 * | 4/2015 | Grubka | E04D 1/26 52/518 |
| 9,404,260 | B2 | 8/2016 | Leitch | |
| 9,540,817 | B2 * | 1/2017 | Folkersen | E04D 5/00 |
| 9,808,947 | B2 | 11/2017 | Grubka et al. | |
| 10,041,253 | B2 * | 8/2018 | Folkersen | E04D 1/30 |
| 10,487,508 | B2 * | 11/2019 | Grubka | E04D 1/36 |

(Continued)

*Primary Examiner* — Adriana Figueroa
(74) *Attorney, Agent, or Firm* — GREENBERG TRAURIG, LLP

(57) ABSTRACT

A bundle of roofing shingles includes at least a first, second, third, and fourth shingle layer, where the first layer includes a first roofing shingle having a first length; the second layer includes a second roofing shingle having a second length and a third roofing shingle having a third length, where the second length is less than the third length, where a sum of the second and third lengths is substantially equal to the first length; the third layer includes a fourth roofing shingle having a fourth length and a fifth roofing shingle having a fifth length, where the fourth length is less than the fifth length, where a sum of the fourth and the fifth lengths is substantially equal to the first length; the fourth layer includes a sixth roofing shingle having a sixth length and a seventh roofing shingle having a seventh length, where the sixth length is less than the seventh length, where a sum of the sixth and seventh lengths is substantially equal to the first length; where each of the first, second, third, fourth, fifth, and sixth lengths is different from one another.

16 Claims, 7 Drawing Sheets

(56) References Cited

U.S. PATENT DOCUMENTS

| | | | | |
|---|---|---|---|---|
| 10,640,979 | B2 * | 5/2020 | Grubka | B65D 71/125 |
| 2015/0308119 | A2 | 5/2015 | Leitch | |
| 2017/0306627 | A1 * | 10/2017 | Grubka | E04D 1/36 |
| 2019/0352906 | A1 | 11/2019 | Grubka et al. | |

* cited by examiner

ROOFING SHINGLES, AND BUNDLE OF ROOFING SHINGLES

REFERENCE TO RELATED APPLICATION

The present patent application claims the benefit of U.S. Provisional Patent Application No. 63/513,620 filed on Jul. 14, 2023, and U.S. Provisional Patent Application No. 63/633,123 filed on Apr. 13, 2024.

INCORPORATION BY REFERENCE

U.S. Provisional Patent Application No. 63/513,620 filed on Jul. 14, 2023, and U.S. Provisional Patent Application No. 63/633,123 filed on Apr. 13, 2024, are specifically incorporated by reference herein as if set forth in their entireties.

FIELD

The present disclosure relates to roofing shingles for installation of a roof deck in a roofing system, as well as bundles of the roofing shingles.

BACKGROUND

In a known roofing system, roofing shingles on installed on a sloped roof deck. The shingles are provided in one or more bundles.

SUMMARY

The Claims, rather than the Summary, define covered embodiments of the present invention. The Summary is a high-level overview of various aspects of the invention and introduces some concepts that are further described in the Detailed Description below. The Summary is not intended to identify key or essential features of the claimed subject matter, and also is not intended to be used in isolation to determine the scope of the claimed subject matter. Instead, the claimed subject matter should be understood by reference to appropriate portions of the Specification and drawings, as well as to each claim.

In some embodiments, the present invention provides a bundle of roofing shingles, comprising: a plurality of layers of roofing shingles, wherein the plurality of layers of roofing shingles comprises at least a first shingle layer, a second shingle layer, a third shingle layer, and a fourth shingle layer, wherein the first shingle layer includes a first roofing shingle, wherein the first roofing shingle has a first length, wherein the second shingle layer includes a second roofing shingle and a third roofing shingle, wherein the second roofing shingle has a second length, wherein the third roofing shingle has a third length, wherein the second length is less than the third length, wherein a sum of the second length and the third length is equal to the first length, wherein the third shingle layer includes a fourth roofing shingle and a fifth roofing shingle, wherein the fourth roofing shingle has a fourth length, wherein the fifth roofing shingle has a fifth length, wherein the fourth length is less than the fifth length, wherein a sum of the fourth length and the fifth length is equal to the first length, wherein the fourth shingle layer includes a sixth roofing shingle and a seventh roofing shingle, wherein the sixth roofing shingle has a sixth length, wherein the seventh roofing shingle has a seventh length, wherein the sixth length is less than the seventh length, wherein a sum of the sixth length and the seventh length is equal to the first length, wherein each of the first length, the second length, the third length, the fourth length, the fifth length, and the sixth length is different from one another.

In some embodiments, the second length is about 13% to about 17% of the first length, and the third length is about 83% to about 87% of the first length.

In some embodiments, the fourth length is about 26% to about 30% of the first length, and the fifth length is about 70% to about 74% of the first length.

In some embodiments, the sixth length is about 41% to about 45% of the first length, and the seventh length is about 55% to about 59% of the first length.

In some embodiments, the second shingle layer is between the first shingle layer and the third shingle layer, and the third shingle layer is between the second shingle layer and the fourth shingle layer.

In some embodiments, the first shingle layer is an uppermost shingle layer of the bundle.

In some embodiments, the first shingle layer is a lowermost shingle layer of the bundle.

In some embodiments, the plurality of layers of roofing shingles comprises at least a fifth shingle layer, a sixth shingle layer, a seventh shingle layer, and an eighth shingle layer, wherein the fifth shingle layer includes an eighth roofing shingle, wherein the eighth roofing shingle has a length equal to the first length, wherein the sixth shingle layer includes a ninth roofing shingle and a tenth roofing shingle, wherein the ninth roofing shingle has a length equal to the second length, wherein the tenth roofing shingle has a length equal to the third length, wherein the seventh shingle layer includes an eleventh roofing shingle and a twelfth roofing shingle, wherein the eleventh roofing shingle has a length equal to the fourth length, wherein the twelfth roofing shingle has a length equal to the fifth length, wherein the eighth shingle layer includes a thirteenth roofing shingle and a fourteenth roofing shingle, wherein the thirteenth roofing shingle has a length equal to the sixth length, wherein the fourteenth roofing shingle has a length equal to the seventh length.

In some embodiments, the first shingle layer is in contact with the fifth shingle layer, the second shingle layer is in contact with the sixth shingle layer, the third shingle layer is in contact with the seventh shingle layer, and the fourth shingle layer is in contact with the eighth shingle layer.

In some embodiments, the present invention provides a bundle of roofing shingles, comprising: a plurality of layers of roofing shingles, wherein the plurality of layers of roofing shingles comprises at least a first shingle layer, a second shingle layer, a third shingle layer, and a fourth shingle layer, wherein the first shingle layer includes a first roofing shingle, wherein the first roofing shingle has a first length, wherein the second shingle layer includes a second roofing shingle and a third roofing shingle, wherein the second roofing shingle has a second length, wherein the second length is about 28% to about 32% of the first length, wherein the third roofing shingle has a third length, wherein the third length is about 68% to about 72% of the first length, wherein a sum of the second length and the third length is equal to the first length, wherein the third shingle layer includes a fourth roofing shingle, wherein the fourth roofing shingle has a length equal to the first length, wherein the fourth shingle layer includes a fifth roofing shingle and a sixth roofing shingle, wherein the fifth roofing shingle has a length equal to the second length, wherein the sixth roofing shingle has a length equal to the third length.

In some embodiments, the first shingle layer is in contact with the second shingle layer, the second shingle layer is in contact with the third shingle layer, and the third shingle layer is in contact with the fourth shingle layer.

In some embodiments, the first shingle layer is an uppermost shingle layer in the bundle.

In some embodiments, the first shingle layer is a lowermost shingle layer in the bundle.

In some embodiments, the present invention provides a method, comprising: obtaining a bundle of roofing shingles, the bundle of roofing shingles comprising: a plurality of layers of roofing shingles, wherein the plurality of layers of roofing shingles comprises at least a first shingle layer, a second shingle layer, a third shingle layer, and a fourth shingle layer, wherein the first shingle layer includes a first roofing shingle, wherein the first roofing shingle has a first length, wherein the second shingle layer includes a second roofing shingle and a third roofing shingle, wherein the second roofing shingle has a second length, wherein the third roofing shingle has a third length, wherein the second length is less than the third length, wherein a sum of the second length and the third length is equal to the first length, wherein the third shingle layer includes a fourth roofing shingle and a fifth roofing shingle, wherein the fourth roofing shingle has a fourth length, wherein the fifth roofing shingle has a fifth length, wherein the fourth length is less than the fifth length, wherein a sum of the fourth length and the fifth length is equal to the first length, wherein the fourth shingle layer includes a sixth roofing shingle and a seventh roofing shingle, wherein the sixth roofing shingle has a sixth length, wherein the seventh roofing shingle has a seventh length, wherein the sixth length is less than the seventh length, wherein a sum of the sixth length and the seventh length is equal to the first length, wherein each of the first length, the second length, the third length, the fourth length, the fifth length, and the sixth length is different from one another; and installing the first roofing shingle, the third roofing shingle, the fifth roofing shingle, and the seventh roofing shingle on a roof deck.

In some embodiments, the installing further comprises: installing the first roofing shingle in a first shingle row on the roof deck, and installing the third roofing shingle in a second shingle row on the roof deck, wherein the second shingle row is above the first shingle row on the roof deck.

In some embodiments, the installing further comprises: installing the fifth roofing shingle in a third shingle row on the roof deck, wherein the third shingle row is above the second shingle row on the roof deck.

In some embodiments, the installing further comprises: installing the seventh roofing shingle in a fourth shingle row on the roof deck, wherein the fourth shingle row is above the third shingle row on the roof deck.

In some embodiments, the second roofing shingle, the fourth roofing shingle, and the sixth roofing shingle are not installed on the roof deck.

In some embodiments, the present invention provides a method, comprising: obtaining a bundle of roofing shingles, the bundle of roofing shingles comprising: a plurality of layers of roofing shingles, wherein the plurality of layers of roofing shingles comprises at least a first shingle layer, a second shingle layer, a third shingle layer, and a fourth shingle layer, wherein the first shingle layer includes a first roofing shingle, wherein the first roofing shingle has a first length, wherein the second shingle layer includes a second roofing shingle and a third roofing shingle, wherein the second roofing shingle has a second length, wherein the second length is about 68% to about 72% of the first length, wherein the third roofing shingle has a third length, wherein the third length is about 28% to about 32% of the first length, wherein a sum of the second length and the third length is equal to the first length, wherein the third shingle layer includes a fourth roofing shingle, wherein the fourth roofing shingle has a length equal to the first length, wherein the fourth shingle layer includes a fifth roofing shingle and a sixth roofing shingle, wherein the fifth roofing shingle has a length equal to the second length, wherein the sixth roofing shingle has a length equal to the third length; and installing the first roofing shingle, the second roofing shingle, the third roofing shingle, the fourth roofing shingle, and the fifth roofing shingle on a roof deck.

In some embodiments, the installing further comprises: installing the first roofing shingle in a first shingle row on the roof deck, installing the second roofing shingle in a second shingle row on the roof deck, wherein the second shingle row is above the first shingle row on the roof deck, and installing the third roofing shingle in a third shingle row on the roof deck, wherein the third shingle row is above the second shingle row on the roof deck.

In some embodiments, the installing further comprises: installing the fourth roofing shingle in the second shingle row adjacent to the second roofing shingle, installing the fifth roofing shingle in the third shingle row adjacent to the third roofing shingle, and installing the sixth roofing shingle in a fourth shingle row on the roof deck, wherein the fourth shingle row is above the third shingle row on the roof deck.

In some embodiments, the present invention provides a roofing system, comprising: a roof deck; and a plurality of roofing shingle installed on the roof deck, wherein the plurality of roofing shingle comprises at least a first roofing shingle, a second roofing shingle, and a third roofing shingle, wherein the first roofing shingle has a first length, wherein the second roofing shingle has a second length, wherein the second length is about 83% to about 87% of the first length, wherein the third roofing shingle has a third length, wherein the third length is about 70% to about 74% of the first length, wherein the first roofing shingle is installed in a first shingle row on the roof deck, wherein the second roofing shingle is installed in a second shingle row on the roof deck, wherein the second shingle row is above the second shingle row on the roof deck, wherein the third roofing shingle is installed in a third shingle row on the roof deck, wherein the third shingle row is above the second shingle row on the roof deck.

In some embodiments, the plurality of roofing shingle comprises at least a fourth roofing shingle, a fifth roofing shingle, and a sixth roofing shingle, wherein the fourth roofing shingle has a fourth length, wherein the fourth length is equal to the first length, wherein the fifth roofing shingle has a fifth length, wherein the fifth length is about 83% to about 87% of the first length, wherein the sixth roofing shingle has a sixth length, wherein the sixth length is about 70% to about 74% of the first length, wherein the fourth roofing shingle is installed in the second shingle row, adjacent to the second roofing shingle, wherein the fifth roofing shingle is installed in the third shingle row, adjacent to the third roofing shingle, wherein the sixth roofing shingle is installed in a fourth shingle row on the roof deck, wherein the fourth shingle row is above the third shingle row on the roof deck.

In some embodiments, an edge of the first roofing shingle is adjacent a rake edge of the roof deck.

In some embodiments, the present invention provides a roofing system, comprising: a roof deck; and a plurality of roofing shingle installed on the roof deck, wherein the plurality of roofing shingle comprises at least a first roofing shingle, a second roofing shingle, and a third roofing shingle, wherein the first roofing shingle has a first length, wherein the second roofing shingle has a second length, wherein the second length is about 68% to about 72% of the first length, wherein the third roofing shingle has a third length, wherein the third length is about 28% to about 32% of the first length, wherein the first roofing shingle is installed in a first shingle row on the roof deck, wherein the second roofing shingle is installed in a second shingle row on the roof deck, wherein the second shingle row is above the second shingle row on the roof deck, wherein the third roofing shingle is installed in a third shingle row on the roof deck, wherein the third shingle row is above the second shingle row on the roof deck.

In some embodiments, the plurality of roofing shingle comprises at least a fourth roofing shingle, a fifth roofing shingle, and a sixth roofing shingle, wherein the fourth roofing shingle has a fourth length, wherein the fourth length is equal to the first length, wherein the fifth roofing shingle has a fifth length, wherein the fifth length is about 68% to about 72% of the first length, wherein the sixth roofing shingle has a sixth length, wherein the sixth length is about 28% to about 32% of the first length, wherein the fourth roofing shingle is installed in the second shingle row, adjacent to the second roofing shingle, wherein the fifth roofing shingle is installed in the third shingle row, adjacent to the third roofing shingle, wherein the sixth roofing shingle is installed in a fourth shingle row on the roof deck, wherein the fourth shingle row is above the third shingle row on the roof deck.

In some embodiments, an edge of the first roofing shingle is adjacent a rake edge of the roof deck.

BRIEF DESCRIPTION OF THE FIGURES

This section refers to the drawings that form a part of this disclosure, and which illustrate some of the embodiments of structure, materials, and/or methods of the present invention described herein.

DETAILED DESCRIPTION

Figure 2:
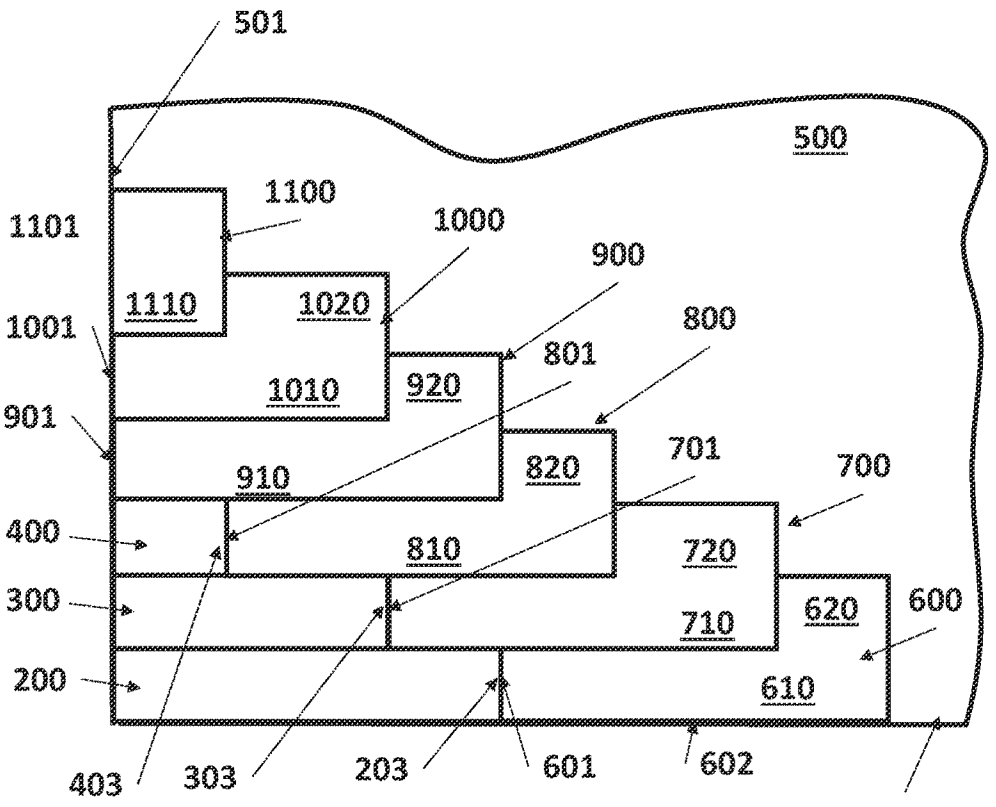
FIG. 2 is a top view of installation of further components of the roofing system of FIG. 1, in accordance with some embodiments.

In addition to the benefits and improvements that the Specification discloses, other objects and advantages that the Specification provides will become apparent from the following description taken in conjunction with the accompanying figures. Although the description discloses and describes detailed embodiments of the present disclosure, the disclosed embodiments are merely illustrative of the disclosure that may be embodied in various forms. In addition, each of the examples given regarding the various embodiments of the disclosure is intended to be illustrative, and not restrictive.

As used herein, a "steep slope" roof or roof deck has a pitch of Y/X, where Y and X are in a ratio of 4:12 to 20:12, where Y corresponds to the "rise" of the roof or roof deck, and where X corresponds to the "run" of the roof or roof deck.

As used herein, a "sloped" roof or roof deck is a roof or roof deck having a pitch greater than zero, but the pitch is less than that of a steep slope roof or roof deck. In some embodiments, the present invention provides a roofing system. In some embodiments, the roofing system in installed on or above a sloped roof deck, such as but not limited to a steep slope roof deck. In some embodiments, the present invention provides a method of installing the roofing system.

In some embodiments, the roofing system results from a diagonal installation of roofing shingles. In some embodiments, the method comprises obtaining roofing shingles. In some embodiments, the method includes installing the shingles diagonally. As used herein, "diagonal" and "diagonally" refer to roofing shingles installed in a stair-step pattern—that is, without going across an entire length of the roof deck before beginning installation on a subsequent, higher shingle row on the roof deck.

In some embodiments, at least some of the shingles are provided by dividing a shingle into two or more shingles. In some embodiments, the dividing occurs prior to beginning installation of the shingles on the roof deck. In some embodiments, the dividing occurs after beginning installation. In some embodiments, the manufacturer divides the shingle. In some embodiments, the installer divides the shingle. In some embodiments, dividing includes any of: separating, severing, pulling, detaching, ripping, breaking, fragmenting, splitting, rending, partitioning, segmenting, cleaving, disjointing, and/or combinations thereof, or any other division of a shingle into two or more shingles.

In some embodiments, one of more the shingles have substantially the same length as one or more of the other shingles. In some embodiments, having substantially a same length means that the shingles are manufactured to a same nominal length, and due to variances in the manufacturing process, one or more shingles are different lengths compared to one or more other shingles.

In some embodiments, an underlayment is installed to cover at least a portion of the roof deck. In some embodiments, there is no underlayment between the shingles and the roof deck.

In some embodiments, one or more of the shingles are installed by penetrating both a nail zone of the shingle and the roof deck with a mechanical fastener, thereby to secure the shingle to the roof deck. In some embodiments, the mechanical fastener includes at least one of a nail, screw, staple, and/or rivet. In some embodiments, one or more of the shingles are adhered to the roof deck.

In some embodiments, one or more of the shingles comprises a tabbed shingle, a three-tab shingle, a multilayer shingle, a laminated shingle, and/or an architectural shingle. In some embodiments, one or more of the shingles includes a first layer and a second layer. In some embodiments, the first layer includes a first portion, and a plurality of tooth portions extending from the first portion. In some embodiments, the first layer is positioned on the second layer.

In some embodiments, a top surface of the shingles includes a plurality of granules thereon. In some embodiments, the described roofing shingles, system, and/or method results in less observable undesirable patterns of roofing granules, as compared to other roofing shingles, systems, and/or methods. In some embodiments, undesirable patterns may include, but are not limited to, observable lines or striping (e.g., vertical, horizontal, and/or diagonal), observable chevrons, observable clustering of colors and/or light areas and/or dark areas, observable repeating shapes and/or patterns, and/or shapes that appear to be non-random.

Figure 1:
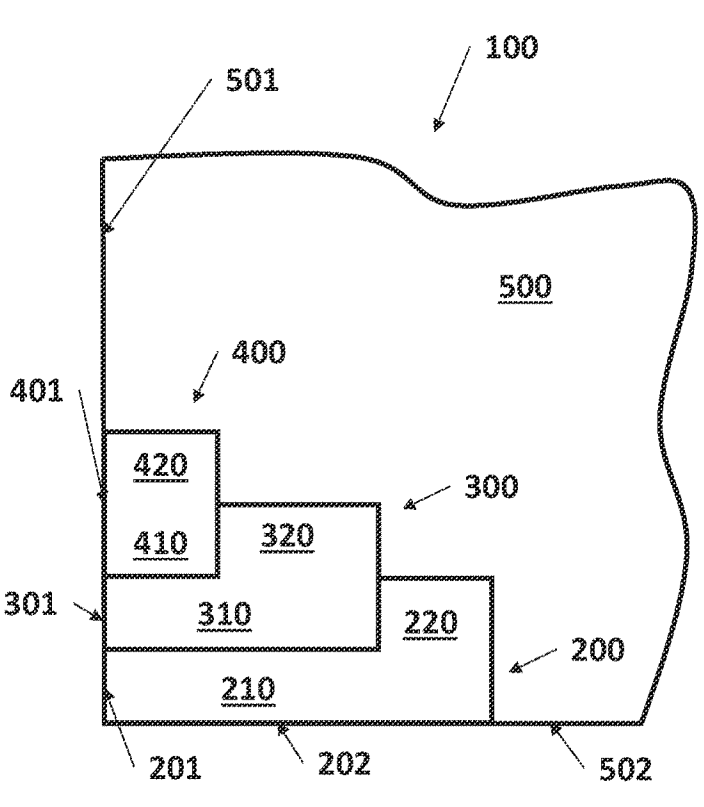
FIG. 1 is a top view of installation of components of a roofing system on a sloped roof deck, in accordance with some embodiments of the invention.

With reference to the drawings, FIG. 1 is a top view of installation of components of a roofing system on a roof deck, in accordance with some embodiments of the invention. As shown in the figure, in some embodiments, the roofing system 100 includes a first shingle 200, a second shingle 300, and a third shingle 400 installed on a roof deck 500. In some embodiments, the first shingle 200 is installed in a first shingle row on the roof deck 500, such that an edge 201 of the first shingle 200 extends along a rake edge 501 of the roof deck 500, and such that another edge 202 of the first shingle 200 extends along an eave edge 502 of the roof deck 500.

As shown, in some embodiments, the second shingle 300 is installed in a second shingle row on the roof deck 500, such that an edge 301 of the second shingle 300 extends along the rake edge 501 of the roof deck 500, where the second shingle row is directly above the first shingle row on the roof deck 500. In some embodiments, as FIG. 1 shows, the second shingle 300 at least partially overlaps the first shingle 200. In some embodiments, a reveal portion 310 of the second shingle 300 overlaps a portion of a headlap portion 220 of the first shingle 200, while a reveal portion 210 of the first shingle 200 remains exposed and visually observable.

In some embodiments, as FIG. 1 shows, the third shingle 400 is installed in a third shingle row on the roof deck 500, such that an edge 401 of the third shingle 400 extends along the rake edge 501 of the roof deck 500, where the third shingle row is directly above the second shingle row on the roof deck 500. As the figure shows, in some embodiments, the third shingle 400 at least partially overlaps the second shingle 300. In some embodiments, a reveal portion 410 of the third shingle 400 overlaps a portion of a headlap portion 320 of the second shingle 300, while a reveal portion 310 of the second shingle 300 remains exposed and visually observable. As FIG. 1 shows, in some embodiments, the shingles are installed diagonally.

With reference to FIG. 2, the figure is a top view of installation of further components of the roofing system of FIG. 1, in accordance with some embodiments of the invention. As shown, in some embodiments, a fourth shingle 600 is installed in the first shingle row on the roof deck 500, such that an edge 601 of the fourth shingle 600 is adjacent another edge 203 of the first shingle 200. In some embodiments, as the figure shows, another edge 602 of the fourth shingle 600 extends along the eave edge 502 of the roof deck 500.

In some embodiments, as FIG. 2 shows, a fifth shingle 700 is installed in the second shingle row on the roof deck 500, such that an edge 701 of the fifth shingle 700 is adjacent another edge 303 of the second shingle 300. As shown, in some embodiments, the fifth shingle 700 at least partially overlaps the first shingle 200 and the fourth shingle 600. For example, in some embodiments, a reveal portion 710 of the fifth shingle 700 overlaps a portion of the headlap portion 220 of the first shingle 200 and a portion of a headlap portion 620 of the fourth shingle 600, such that a reveal portion 610 of the fourth shingle 600 remains exposed and visually observable.

As shown in FIG. 2, in some embodiments, a sixth shingle 800 is installed in the third shingle row on the roof deck 500, such that an edge 801 of the sixth shingle 800 is adjacent another edge 403 of the third shingle 400. In some embodiments, the sixth shingle 800 at least partially overlaps the second shingle 300 and the fifth shingle 700. As shown, in some embodiments, a reveal portion 810 of the sixth shingle 800 overlaps a portion of the headlap portion 320 of the second shingle 300 and a portion of the headlap portion 720 of the fifth shingle 700, such that a reveal portion 710 of the fifth shingle 700 remains exposed and visually observable.

As the figure also shows, in some embodiments, a seventh shingle 900 is installed in a fourth shingle row on the roof deck, such that an edge 901 of the seventh shingle 900 extends along the rake edge 501 of the roof deck 500, where the fourth shingle row is directly above the third shingle row on the roof deck 500, as FIG. 2 shows. In some embodiments, the seventh shingle 900 at least partially overlaps the third shingle 400 and the sixth shingle 800. As shown, in some embodiments, a reveal portion 910 of the seventh shingle 900 overlaps a portion of a headlap portion 420 of the third shingle 400 and a portion of a headlap portion 820 of the sixth shingle 800, such that the reveal portion 810 of the sixth shingle 800 remains exposed and visually observable.

As FIG. 2 shows, in some embodiments, an eighth shingle 1000 is installed in a fifth shingle row on the roof deck, such that an edge 1001 of the eighth shingle 1000 extends along the rake edge 501 of the roof deck 500, where the fifth shingle row is directly above the fourth shingle row on the roof deck 500. As shown, in some embodiments, a reveal portion 1010 of the eighth shingle 1000 overlaps a portion of the headlap portion 920 of the seventh shingle 900.

As shown in FIG. 2, in some embodiments, a ninth shingle 1100 is installed in a sixth shingle row on the roof deck 500, such that an edge 1101 of the ninth shingle 1100 extends along the rake edge 501 of the roof deck 500, where the sixth shingle row is directly above the fifth shingle row on the roof deck 500. As shown, in some embodiments, a reveal portion 1110 of the ninth shingle 1100 overlaps a portion of the headlap portion 1020 of the eighth shingle 1000.

As shown in FIG. 2, in some embodiments, the shingles are installed on the roof deck 500 diagonally. In some embodiments, one or more additional shingles may be installed on the roof deck 500, such that an entirety of the roof deck 500 is covered by the shingles.

In some embodiments, one or more of the first shingle 200, the fourth shingle 600, the fifth shingle 700, the sixth shingle 800, and/or the seventh shingle 900, has a length of about 39⅜ inches. In some embodiments, one or more of the third shingle 400 and/or the ninth shingle 1100 has a length of about 12 inches. In some embodiments, one or more of the second shingle 300 and/or the eighth shingle 1000 has a length of about 27⅜ inches. In some embodiments, a sum of the length of one of the third shingle 400 or the ninth shingle 1100, and the length of one of the second shingle 300 or the eighth shingle 1000 is about equal to the length of one of the first shingle 200, the fourth shingle 600, the fifth shingle 700, the sixth shingle 800, or the seventh shingle 900.

In some embodiments, the length ("shorter length") of the one or more of the third shingle 400 and/or the ninth shingle 1100 is about 28% to about 32% of the length ("longer length") of one or more of the first shingle 200, the fourth shingle 600, the fifth shingle 700, the sixth shingle 800, and/or the seventh shingle 900.

In some embodiments, the shorter length is about 25% to about 35% of the longer length. In some embodiments, the shorter length is about 28% to about 35% of the longer length. In some embodiments, the shorter length is about 25% to about 34% of the longer length In some embodiments, the shorter length is about 28% to about 34% of the longer length. In some embodiments, the shorter length is about 30% to about 34% of the longer length. In some embodiments, the shorter length is about 25% to about 33% of the longer length. In some embodiments, the shorter length is about 30% to about 33% of the longer length.

In some embodiments, the length ("shorter length") of the one or more of the second shingle 300 and/or the eighth shingle 1000 is about 68% to about 72% of the length ("longer length") of one or more of the first shingle 200, the fourth shingle 600, the fifth shingle 700, the sixth shingle 800, and/or the seventh shingle 900.

In some embodiments, the shorter length is about 65% to about 75% of the longer length In some embodiments, the shorter length is about 68% to about 75% of the longer length. In some embodiments, the shorter length is about 70% to about 75% of the longer length. In some embodiments, the shorter length is about 65% to about 74% of the longer length In some embodiments, the shorter length is about 68% to about 74% of the longer length. In some embodiments, the shorter length is about 65% to about 73% of the longer length. In some embodiments, the shorter length is about 68% to about 73% of the longer length.

In some embodiments, one or more of the third shingle 400 and/or the ninth shingle 1100, and/or one or more shingles of similar length, and/or one or more of the second shingle 300 and/or the eighth shingle 1000, and/or one or more shingles of similar length, are provided by cutting shingles of a same length as one or more of the first shingle 200, the fourth shingle 600, the fifth shingle 700, the sixth shingle 800, and/or the seventh shingle 900.

In some embodiments, one or more of the disclosed and/or illustrated shingles are stacked in shingle layers, which contact one another, in a shingle bundle. In some embodiments, one or more of the same bundles and/or different bundles are positioned on a job site. In some embodiments, shingles from one or more of the same bundles and/or different bundles are installed on the roof deck 500. In some embodiments, one or more of the bundles includes one or more shingle layers, the shingle layers including full length shingles (e.g., shingles of about 38⅜ inches in length), and shingle layers including two shingles, the sum of which are about equal to the length of the full-length shingle. In some embodiments, one or more of the bundles include only shingle layers having full length shingles. In some embodiments, one or more of the bundles include shingle layers having two shingles, the sum of which are about equal to the length of the full-length shingle.

Figure 3:
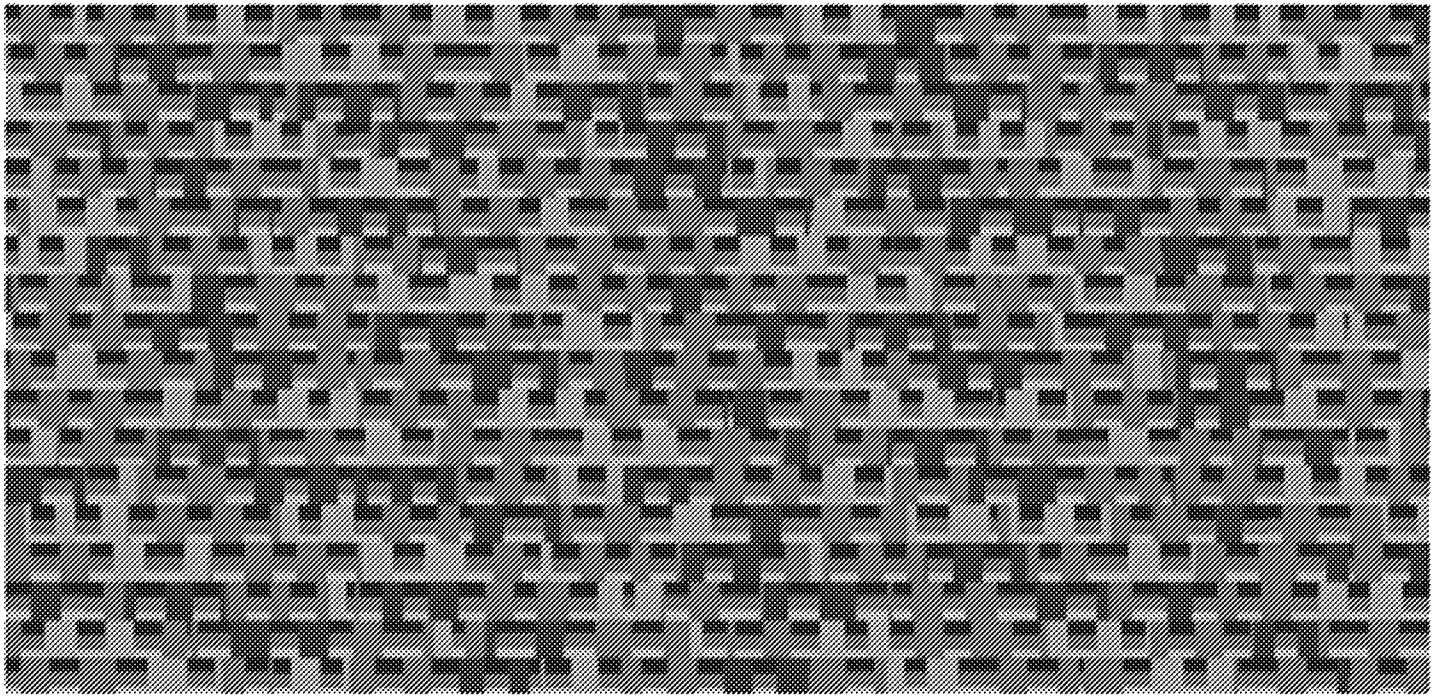
FIG. 3 is a picture of a computer simulation showing roofing shingles laid out on roof decks using bundles of roofing shingles and methods thereof in accordance with embodiments of the invention.
Figure 4:
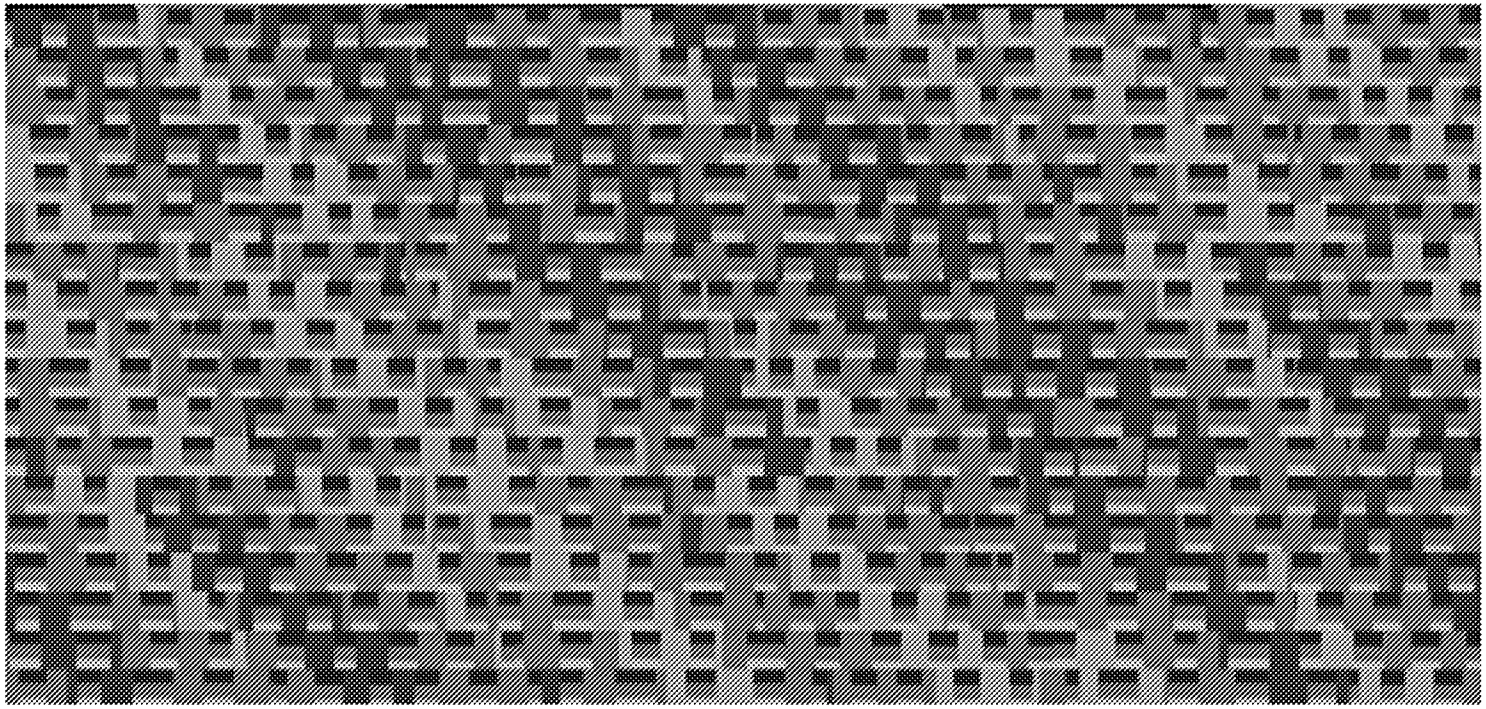
FIG. 4 is a picture of a computer simulation showing roofing shingles laid out on roof decks using a conventional method of installation with conventional bundle of shingles.

FIGS. 3 and 4 shows the results of computer simulations. FIG. 3 shows a simulated picture of roofing shingles laid out on a roof deck using bundles of roofing shingles and methods thereof in accordance with embodiments of the invention, while FIG. 4 shows a simulated picture of roofing shingles laid out on a roof deck using a conventional method of installation with conventional bundle of shingles. As may be seen, FIG. 4 shows diagonal stripes of light and dark areas, which are absent from FIG. 3. Thus, as a comparison of the figure shows, bundle of roofing shingles and methods thereof in accordance with embodiments of the invention laid out on a roof deck result in a more aesthetically pleasing roof.

Figure 5:
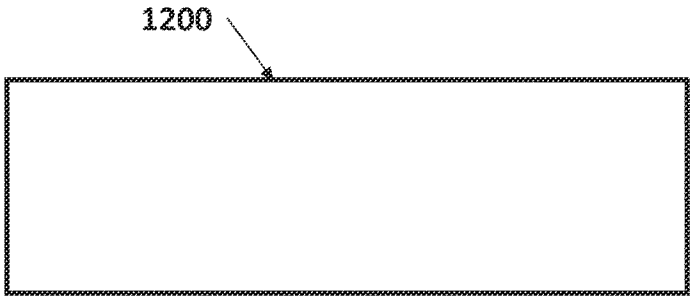

FIGS. 5-8 are top views of roofing shingles, in accordance with some embodiments of the invention, which may be installed on the roof deck 500. FIG. 5 shows a top view of a first shingle 1200. In some embodiments, the first shingle 1200 is a complete shingle that does not include any cuts and/or perforations for division of the first shingle 1200 into multiple segments. In some embodiments, the first shingle 1200 is in accordance with any of the shingles disclosed above. In some embodiments, the first shingle has a length of about 39⅜ inches.

Figure 6:
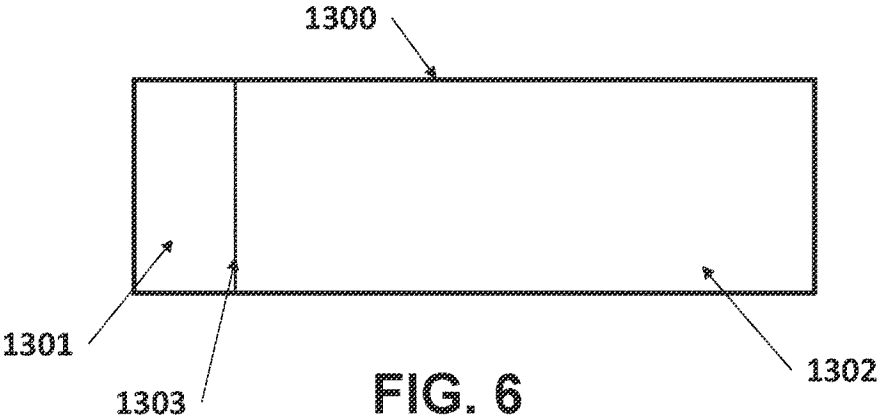
FIG. 5-8 are top views of roofing shingles, in accordance with some embodiments.

FIG. 6 shows a top view of a second shingle 1300. In some embodiments, the second shingle 1300 is configured to be divided into a third shingle 1301 and a fourth shingle 1302. In some embodiments, the third shingle 1301 is divided from the fourth shingle 1302. In some embodiments, a sum of the lengths of the third shingle 1301 and the fourth shingle 1302 are about equal to a length of a complete, undivided roofing shingle, such as the second shingle 1300. In some embodiments, one or both of the third shingle 1301 and/or the fourth shingle 1302 are configured to be installed on the roof deck 500, as set forth above. In some embodiments, only one of the third shingle 1301 or the fourth shingle 1302 is intended to be installed on the roof deck 500. In some embodiments, the fourth shingle 1302 is intended to be installed on the roof deck 500.

In some embodiments, the second shingle 1300 has a length of about 39⅜ inches, the third shingle 1301 has a length of about 6 inches, and the fourth shingle 1302 has a length of about 33⅜ inches.

In some embodiments, the length ("shorter length") of the third shingle 1301 is about 13% to 17% of a length of the second shingle 1300 ("longer length").

In some embodiments, the shorter length is about 10% to about 20% of the longer length. In some embodiments, the shorter length is about 15% to about 20% of the longer length. In some embodiments, the shorter length is about 10% to about 19% of the longer length. In some embodiments, the shorter length is about 15% to about 19% of the longer length.

In some embodiments, and the length ("shorter length") of the fourth shingle 1302 is about 83% to about 87% of the length ("longer length") of the second shingle 1300.

In some embodiments, the shorter length is about 80% to about 90% of the longer length. In some embodiments, the shorter length is about 85% to about 90% of the longer length. In some embodiments, the shorter length is about 80% to about 89% of the longer length. In some embodiments, the shorter length is about 85% to about 89% of the longer length.

In some embodiments, the second shingle 1300 includes one or more dividing lines 1303. In some embodiments, the dividing lines 1303 includes one or more of surface markings (e.g., one or more paint lines), cuts, and/or perforations, at least one of indicating where to divide, facilitating division, at least partially dividing, and/or dividing the third shingle 1301 from the fourth shingle 1302. In some embodiments, the third shingle 1301 is provided separated from the fourth shingle 1302.

Figure 7:
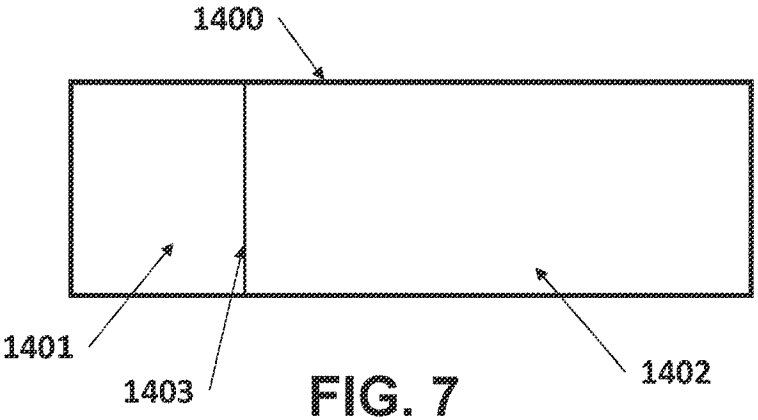

FIG. 7 shows a top view of a fifth shingle 1400. In some embodiments, the fifth shingle 1400 is configured to be divided into a sixth shingle 1401 and a seventh shingle 1402. Thus, in some embodiments, a sum of the lengths of the sixth shingle 1401 and the seventh shingle 1402 are about equal to a length of a complete, undivided roofing shingle, such as the first shingle 1200 and/or the second shingle 1300. In some embodiments, one or both of the sixth shingle 1401 and/or the seventh shingle 1402 are configured to be installed on the roof deck 500. In some embodiments, only one of the sixth shingle 1401 or the seventh shingle 1402 is intended to be installed on the roof deck 500. In some embodiments, only the seventh shingle 1402 is intended to be installed on the roof deck 500.

In some embodiments, the fifth shingle 1400 has a length of about 39⅜ inches, the sixth shingle 1401 has a length of about 11 inches, and the seventh shingle 1402 has a length of about 28⅜ inches.

In some embodiments, the length ("shorter length") of the sixth shingle 1401 is about 26% to 30% of a length of the fifth shingle 1400 ("longer length").

In some embodiments, the shorter length is about 23% to about 33% of the longer length. In some embodiments, the shorter length is about 25% to about 33% of the longer length. In some embodiments, the shorter length is about 25% to about 32% of the longer length.

In some embodiments, and the length ("shorter length") of the seventh shingle 1402 is about 70% to 74% of the length ("longer length") of the fifth shingle 1400.

In some embodiments, the shorter length is about 67% to about 77% of the longer length. In some embodiments, the shorter length is about 70% to about 77% of the longer length In some embodiments, the shorter length is about 67% to about 76% of the longer length In some embodiments, the shorter length is about 71% to about 76% of the longer length In some embodiments, the shorter length is about 70% to about 75% of the longer length In some embodiments, the fifth shingle 1400 includes one or more dividing lines 1403. In some embodiments, the dividing lines 1403 include one or more of surface markings (e.g., one or more paint lines), cuts, and/or perforations, at least one of indicating where to divide, facilitating division, at least partially dividing, and/or dividing the sixth shingle 1401 from the seventh shingle 1402. In some embodiments, the sixth shingle 1401 is provided separated from the seventh shingle 1402.

Figure 8:
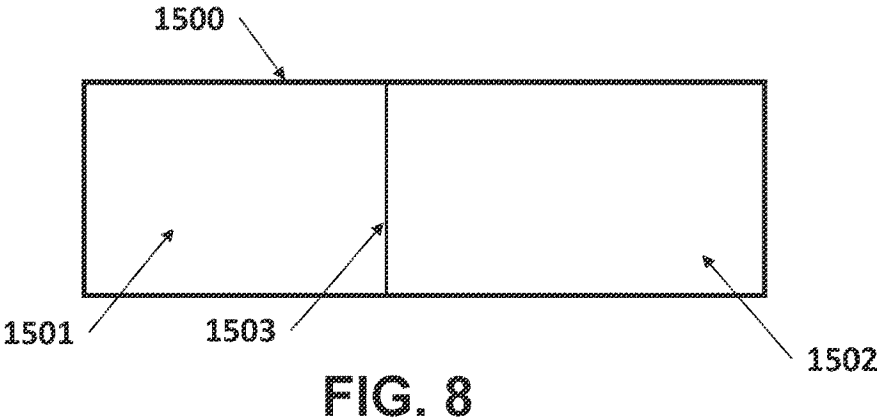

FIG. 8 shows a top view of an eighth shingle 1500. In some embodiments, the eighth shingle 1500 is configured to be divided into a ninth shingle 1501 and a tenth shingle 1502. Thus, in some embodiments, lengths of the ninth shingle 1501 and the tenth shingle 1502 are about equal to a length of a complete, undivided roofing shingle, such as the first shingle 1200, the second shingle 1300, and/or the fifth shingle 1400. In some embodiments, one or both of the ninth shingle 1501 and/or the tenth shingle 1502 are configured to be installed on the roof deck 500. In some embodiments, only one of the ninth shingle 1501 or the tenth shingle 1502 is intended to be installed on the roof deck 500. In some embodiments, only the tenth shingle 1502 is intended to be installed on the roof deck 500.

In some embodiments, the eighth shingle 1500 has a length of about 39⅜ inches, the ninth shingle 1501 has a length of about 17 inches, and the tenth shingle 1502 has a length of about 22⅜ inches.

In some embodiments, the length ("shorter length") of the ninth shingle 1501 is about 41% to 45% of a length of the eighth shingle 1500 ("longer length").

In some embodiments, the shorter length is about 38% to about 48% of the longer length. In some embodiments, the shorter length is about 40% to about 48% of the longer length. In some embodiments, the shorter length is about 38% to about 47% of the longer length In some embodiments, the shorter length is about 43% to about 47% of the longer length.

In some embodiments, and the length ("shorter length") of the tenth shingle 1502 is about 55% to 59% of the length ("longer length") of the eighth shingle 1500.

In some embodiments, the shorter length is about 52% to about 62% of the longer length. In some embodiments, the shorter length is about 55% to about 62% of the longer length. In some embodiments, the shorter length is about 55% to about 61% of the longer length.

In some embodiments, the eighth shingle 1500 includes one or more dividing lines 1503. In some embodiments, the dividing lines 1503 include one or more of surface markings (e.g., one or more paint lines), cuts, and/or perforations, at least one of indicating where to divide, facilitating division, at least partially dividing, and/or dividing the ninth shingle 1501 from the tenth shingle 1502. In some embodiments, the ninth shingle 1501 is provided separated from the tenth shingle 1502.

In some embodiments, one or more of the disclosed and/or illustrated shingles are stacked in shingle layers, which contact one another, within a shingle bundle. In some embodiments, one or more of the same bundles and/or different bundles are positioned on a job site. In some embodiments, shingles from one or more of the same bundles and/or different bundles are installed on the roof deck 500. In some embodiments, one or more of the bundles includes one or more shingle layers, the shingle layers including full length shingles (e.g., shingles of about 38⅜ inches in length), and shingle layers including two shingles, the sum of which are about equal to the length of the full-length shingle. In some embodiments, one or more of the bundles include only shingle layers having full length shingles. In some embodiments, one or more of the bundles include shingle layers having two shingles, the sum of which are about equal to the length of the full-length shingle. In some embodiments, one or more of the bundles includes one or more shingle layers, including: the first shingle 1200; the second shingle 1300 or the third shingle 1301 and the fourth shingle 1302; the fifth shingle 1400 or the sixth shingle 1401 and the seventh shingle 1402; and/or the eighth shingle 1500 or the ninth shingle 1501 and the tenth shingle 1502.

In some embodiments, the bundle include at least one set of four layers of shingles, each set of four layers including one layer of each of the first shingle 1200; either the second shingle 1300, or the third shingle 1301 and the fourth shingle 1304; either the fifth shingle 1400, or the sixth shingle 1401 and the seventh shingle 1402; and the eighth shingle 1500, or the ninth shingle 1501 and the tenth shingle 1502. In some embodiments, the bundle includes more than one set of four layers of shingles.

In some embodiments, the set of four layers of shingles is stacked such that: the second shingle 1300, or the third shingle 1301 and the fourth shingle 1302, are between the first shingle 1200 and the fifth shingle 1400 or the sixth shingle 1401 and the seventh shingle 1402; and such that the fifth shingle 1400, or the sixth shingle 1401 and the seventh shingle 1402, are between either the second shingle 1300 or the third shingle 1301 and the fourth shingle 1302, and either the eighth shingle 1500 or the ninth shingle 1501 and the tenth shingle 1502.

In some embodiments, the bundle of shingles includes, from a bottom of lowermost layer of the bundle to a top or uppermost layer of the bundle: two layers of the first shingle 1200; two layers of either the second shingle 1300 or the third shingle 1301 and the fourth shingle 1302; two layers of either the fifth shingle 1400 or the sixth shingle 1401 and the seventh shingle 1402; and two layers of either the eighth shingle 1500 or the ninth shingle 1501 and the tenth shingle 1502. In some embodiments, the bundle includes the layers as described above, but the bundle is stacked opposite or upside down, such that two of the first shingles 1200 are at the top of the bundle in an uppermost row.

Figure 10:
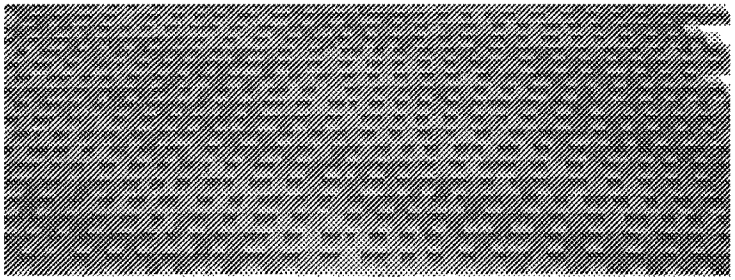
FIG. 10 is an image showing roofing shingles laid out on a roof deck using a conventional method of installation with conventional bundle of shingles.
Figure 9:
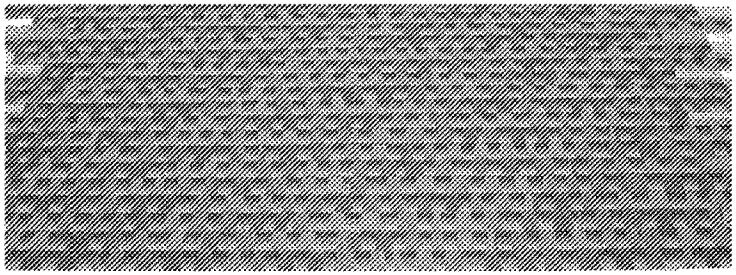
FIG. 9 is an image of roofing shingles laid out on a roof deck using bundles of roofing shingles and methods thereof in accordance with embodiments of the invention.
Figure 12:
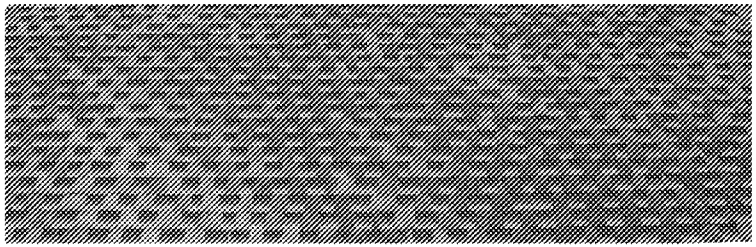
FIG. 12 is an image showing roofing shingles laid out on a roof deck using a conventional method of installation with conventional bundle of shingles.
Figure 11:
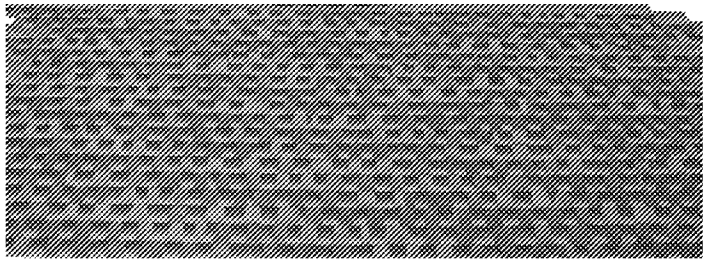
FIG. 11 is an image of roofing shingles laid out on a roof deck using bundles of roofing shingles and methods thereof in accordance with embodiments of the invention.
Figure 14:
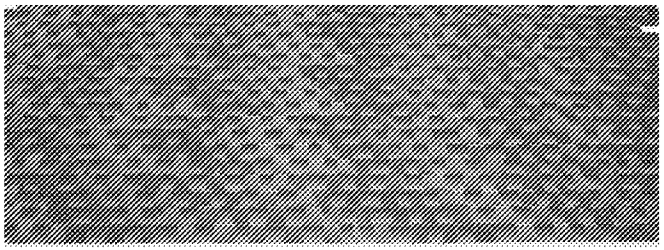
FIG. 14 is an image showing roofing shingles laid out on a roof deck using a conventional method of installation with conventional bundle of shingles.
Figure 13:
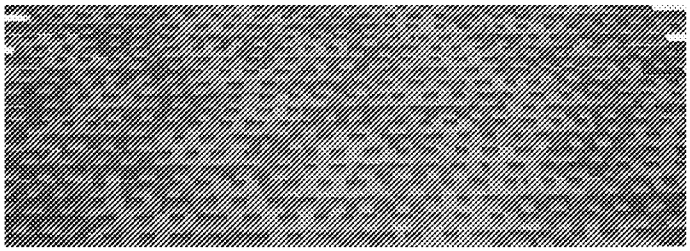
FIG. 13 is an image of roofing shingles laid out on a roof deck using bundles of roofing shingles and methods thereof in accordance with embodiments of the invention.

FIGS. 9 through 14 are actual images of roofing shingles laid out on roof decks. FIGS. 9, 11 and 13 illustrate three examples of roofing shingles laid out on roof decks using bundles of roofing shingles and methods thereof in accordance with embodiments of the invention. FIGS. 10, 12 and 14 illustrate three examples of roofing shingles laid out on roof decks using a conventional method of installation with conventional bundle of shingles. As may be seen, FIGS. 10, 12 and 14 shows diagonal stripes of light and dark areas, which are absent from FIGS. 9, 11 and 13. Thus, as a comparison of the figure shows, bundle of roofing shingles and methods thereof in accordance with embodiments of the invention laid out on roof decks result in a more aesthetically pleasing roof.

Variations, modifications, and alterations to embodiments of the present disclosure described above will make themselves apparent to those skilled in the art. All such variations, modifications, alterations and the like are intended to fall within the spirit and scope of the present disclosure, limited solely by the appended claims. While several embodiments of the present disclosure have been described, it is understood that these embodiments are illustrative only, and not restrictive, and that many modifications may become apparent to those of ordinary skill in the art. For example, all dimensions discussed herein are provided as examples only, and are intended to be illustrative and not restrictive. Any feature or element that is positively identified in this description may also be specifically excluded as a feature or element of an embodiment of the present as defined in the claims.

The disclosure described herein may be practiced in the absence of any element or elements, limitation or limitations, which is not specifically disclosed herein. The terms and expressions which have been employed are used as terms of description and not of limitation, and there is no intention in the use of such terms and expressions of excluding any equivalents of the features shown and described or portions thereof, but it is recognized that various modifications are possible within the scope of the disclosure.

The invention claimed is:

1. A bundle of roofing shingles, comprising:
a plurality of layers of roofing shingles,
wherein the plurality of layers of roofing shingles comprises at least a first shingle layer, a second shingle layer, a third shingle layer, and a fourth shingle layer,
wherein the first shingle layer includes a first roofing shingle,
wherein the first roofing shingle has a first length,
wherein the second shingle layer directly contacts the first shingle layer and includes a second roofing shingle and a third roofing shingle,
wherein the second roofing shingle has a second length,
wherein the third roofing shingle has a third length,
wherein the second length is less than the third length,
wherein a sum of the second length and the third length is substantially equal to the first length,
wherein the third shingle layer directly contacts the second shingle layer and includes a fourth roofing shingle and a fifth roofing shingle,
wherein the fourth roofing shingle has a fourth length,
wherein the fifth roofing shingle has a fifth length,
wherein the fourth length is less than the fifth length,
wherein a sum of the fourth length and the fifth length is substantially equal to the first length,
wherein the fourth shingle layer directly contacts the third shingle layer and includes a sixth roofing shingle and a seventh roofing shingle,
wherein the sixth roofing shingle has a sixth length,
wherein the seventh roofing shingle has a seventh length, wherein the sixth length is less than the seventh length,
wherein a sum of the sixth length and the seventh length is substantially equal to the first length,
wherein each of the first length, the second length, the third length, the fourth length, the fifth length, and the sixth length is different from one another and
wherein the first, second, third and fourth shingle layers are configured, when installed on a roof, to be installed in the same order as in the bundle.

2. The bundle of roofing shingles of claim 1, wherein the second length is about 13% to about 17% of the first length,
wherein the third length is about 83% to about 87% of the first length.

3. The bundle of roofing shingles of claim 1, wherein the fourth length is about 26% to about 30% of the first length,
wherein the fifth length is about 70% to about 74% of the first length.

4. The bundle of roofing shingles of claim 1, wherein the sixth length is about 41% to about 45% of the first length,
wherein the seventh length is about 55% to about 59% of the first length.

5. The bundle of roofing shingles of claim 1, wherein the second shingle layer is between the first shingle layer and the third shingle layer,
wherein the third shingle layer is between the second shingle layer and the fourth shingle layer.

6. The bundle of roofing shingles of claim 5, wherein the first shingle layer is an uppermost shingle layer of the bundle.

7. The bundle of roofing shingles of claim 5, wherein the first shingle layer is a lowermost shingle layer of the bundle.

8. A bundle of roofing shingles, comprising:
a plurality of layers of roofing shingles,
wherein the plurality of layers of roofing shingles comprises at least a first shingle layer, a second shingle layer, a third shingle layer, and a fourth shingle layer,
wherein the first shingle layer includes a first roofing shingle,
wherein the first roofing shingle has a first length,
wherein the second shingle layer directly contacts the first shingle layer and includes a second roofing shingle and a third roofing shingle, wherein the second roofing shingle has a second length, wherein the second length is about 28% to about 32% of the first length, wherein the third roofing shingle has a third length, wherein the third length is about 68% to about 72% of the first length, wherein a sum of the second length and the third length is substantially equal to the first length, wherein the third shingle layer directly contacts the second shingle layer and includes a fourth roofing shingle, wherein the fourth roofing shingle has a length substantially equal to the first length, wherein the fourth shingle layer directly contacts the third shingle layer and includes a fifth roofing shingle and a sixth roofing shingle, wherein the fifth roofing shingle has a length substantially equal to the second length, wherein the sixth roofing shingle has a length substantially equal to the third length and wherein the first, second, third and fourth layers are configured, when installed on a roof, to be installed in the same order as in the bundle.

9. The bundle of roofing shingles of claim 8, wherein the first shingle layer is a lowermost shingle layer of the bundle.

10. A method, comprising:

obtaining a bundle of roofing shingles, the bundle of roofing shingles comprising:

a plurality of layers of roofing shingles, wherein the plurality of layers of roofing shingles comprises at least a first shingle layer, a second shingle layer, a third shingle layer, and a fourth shingle layer, wherein the first shingle layer includes a first roofing shingle, wherein the first roofing shingle has a first length, wherein the second shingle layer directly contacts the first shingle layer and includes a second roofing shingle and a third roofing shingle, wherein the second roofing shingle has a second length, wherein the third roofing shingle has a third length, wherein a sum of the second length and the third length is substantially equal to the first length, wherein the third shingle layer directly contacts the second shingle layer and includes a fourth roofing shingle and a fifth roofing shingle, wherein the fourth roofing shingle has a fourth length, wherein the fifth roofing shingle has a fifth length, wherein a sum of the fourth length and the fifth length is substantially equal to the first length, wherein the fourth shingle layer directly contacts the third shingle layer and includes a sixth roofing shingle and a seventh roofing shingle, wherein the sixth roofing shingle has a sixth length, wherein the seventh roofing shingle has a seventh length, wherein a sum of the sixth length and the seventh length is substantially equal to the first length, wherein each of the first length, the second length, the third length, the fourth length, the fifth length, and the sixth length is different from one another; and installing the first roofing shingle, the third roofing shingle, the fifth roofing shingle, and the seventh roofing shingle on a roof deck in the same order as in the bundle.

11. The method of claim 10, wherein the installing comprises:

installing the first roofing shingle in a first shingle row on the roof deck, and installing the third roofing shingle in a second shingle row on the roof deck, wherein the second shingle row is above the first shingle row on the roof deck.

12. The method of claim 10, wherein the installing further comprises:

installing the fifth roofing shingle in a third shingle row on the roof deck, wherein the third shingle row is above the second shingle row on the roof deck.

13. The method of claim 11, wherein the installing further comprises:

installing the seventh roofing shingle in a fourth shingle row on the roof deck, wherein the fourth shingle row is above the third shingle row on the roof deck.

14. The method of claim 12, wherein the second roofing shingle, the fourth roofing shingle, and the sixth roofing shingle are not installed on the roof deck.

15. The method of claim 13, wherein the installing comprises:

installing the first roofing shingle in a first shingle row on the roof deck, installing the second roofing shingle in a second shingle row on the roof deck, wherein the second shingle row is above the first shingle row on the roof deck, and installing the third roofing shingle in a third shingle row on the roof deck, wherein the third shingle row is above the second shingle row on the roof deck.

16. The method of claim 14, wherein the installing further comprises:

installing the fourth roofing shingle in the second shingle row adjacent to the second roofing shingle, installing the fifth roofing shingle in the third shingle row adjacent to the third roofing shingle, and installing the sixth roofing shingle in a fourth shingle row on the roof deck, wherein the fourth shingle row is above the third shingle row on the roof deck.

* * * * *